United States Patent [19]

Mason

[11] 4,062,312

[45] Dec. 13, 1977

[54] METHOD FOR DEFORMING AND COATING A METALLIC SURFACE

[75] Inventor: Lewis T. Mason, Goshen, Ohio

[73] Assignee: Astro Containers, Inc., Evendale, Ohio

[21] Appl. No.: 683,664

[22] Filed: May 6, 1976

[51] Int. Cl.[2] ..... B21D 51/32; B21D 51/20

[52] U.S. Cl. ..... 113/120 A; 72/42; 72/46; 252/56 S

[58] Field of Search ..... 72/42, 46; 113/120 A; 252/56 S

[56] References Cited

U.S. PATENT DOCUMENTS

| | | | |
|---|---|---|---|
| 2,802,787 | 8/1957 | Matuszak et al. | 252/56 S |
| 3,105,400 | 10/1963 | Goppelt | 72/42 |
| 3,194,428 | 7/1965 | Dereich | 113/120 A |
| 3,826,675 | 7/1974 | Smith et al. | 252/56 S |

*Primary Examiner*—E. M. Combs

*Attorney, Agent, or Firm*—Melville, Strasser, Foster & Hoffman

[57] ABSTRACT

An improved method for deforming and coating a metallic surface. A portion at least of the metallic surface is operated upon by the forming surface of a forming machine, the forming surface being lubricated with certain homologs of lactic acid of the $C_NH_{2N+1}$ series. A water-borne coating is then applied to the metallic surface, including the deformed portion thereof, with substantially no interference from the lubricant.

10 Claims, 4 Drawing Figures

METHOD FOR DEFORMING AND COATING A METALLIC SURFACE

BACKGROUND OF THE INVENTION

The present invention generally relates to a process for deforming and coating metallic surfaces and, more particularly, to a process for deforming and coating metallic surfaces in association with the manufacture of steel drums and pails.

It is known in the prior art to manufacture steel drums by forming a sheet of steel into cylindrical shape and welding the joint to form a longitudinal seam. In one type of drum, commonly referred to as a "tight-head" drum in the industry, circular top and bottom heads are then cut from another sheet of steel and affixed to the cylindrical shell by means of an operation commonly referred to as "seaming". In the "seaming" operation, lubricated forming rolls are utilized to join the heads to flanges extending from the cylindrical shell in a two-step folding process. In a second type of drum, known in the industry as a "full-removable-head" drum, the bottom head is joined to the cylindrical shell by the "seaming" operation while the top head is secured so as to be fully removable from the shell. Typically, the metal top of the shell is rolled to form a "false wire" or "bead" to which the top head is secured by means of a closing ring. An appropriate gasket may also be provided to insure adequate sealing. Also, prior to the actual "seaming" operation, an appropriate sealing compound may be applied to the bottom head in the case of full-removable-head drum and to both the top and bottom heads for a tight-head drum. The design and construction requirements for both types of drums is fully disclosed in the USA Standard Specification for Metal Drums and Pails, published by the United States of America Standards Institute, which is incorporated herein by reference.

Subsequently, special purpose drum enamels, which provide the desired paint film properties of high gloss, good abrasion and wear resistance, good weathering properties such as fade resistance and gloss retention, and good corrosion resistance, are applied to the exterior of the drum which is then ready for shipment to the user. Frequently, a "baking enamel" which is heat-cured in an oven is used for this purpose.

To best insure the provision of the aforementioned desired properties, prior art drum coatings have typically comprised solvent-based formulations. However, in view of the recently increased emphasis on air pollution control and energy conservation, it would be highly desirable to utilize drum coatings comprising water-borne formulations rather than the solvent-based formulations widely used at the present time. Although substitutions of water-borne drum finishes for the solvent based types have been attempted, these attempts have not produced altogether satisfactory results. The primary impediment to the workable substitution is attributable to the contamination of the metal surface of the drums introduced by the forming lubricants during the "seaming" or other metal forming operations. Although the surface contamination introduced by the lubricants, which are typically petroleum based products, apparently does not interfere with the application of solvent-based coatings to the drums, their presence on the metal drum surface seriously interferes with the integrity of the coatings when the application of a water-borne formulation is attempted. Due primarily to this limitation, the industry has not accepted the use of water-borne drum finishes even though certain highly desirable advantages could be achieved thereby.

SUMMARY OF THE INVENTION

It is a general object of the present invention to provide an improved process for deforming and coating metallic surfaces. More specifically, it is an object of the present invention to provide a process wherein a steel drum manufactured partially in accordance with prior art techniques may receive a coating comprising a water-borne formulation whose integrity on the drum surface would be of a nature acceptable to the industry.

In accordance with these and other useful objects, the present invention contemplates the discovery of a method of lubricating conventional steel drum forming machinery so as to enable the application of water-borne coatings to the exterior drum surface subsequent to the forming operation. Essentially, the invention comprises the discovery that the substitution of butyl lactate for the conventional lubricants, typically petroleum based, used with prior art steel drum forming machinery permits the acceptable application of water-borne coatings to the exterior drum surface subsequent to the forming operation. That is, the residue of butyl lactate lubricant left on the deformed metal surfaces by the forming machinery forming rolls has been found not to interfere with the integrity of a water-based coating subsequently applied to the metal.

In addition to providing a method whereby a water-based coating may acceptably be applied to the exterior surface of a steel drum, other unexpected benefits have been noted with regard to the use of butyl lactate as a lubricant in steel drum forming machinery. In particular, it has been noted that the drum chimes are more nearly uniform, that there are fewer defective units produced, that the chimes have fewer burrs and sharp edges and that the forming rolls do not wear out as rapidly. Other homologs of lactic acid of the $C_NH_{2N+1}$ series which may be used for this purpose in addition to butyl lactate include methyl lactate, ethyl lactate, propyl lactate and amyl lactate as well as mixtures thereof.

Due to the fact that the common uses of butyl lactate are totally unrelated to lubrication, it is believed that the method of the present invention provides a completely unexpected result.

DESCRIPTION OF THE PREFERRED EMBODIMENTS

Figure 1:
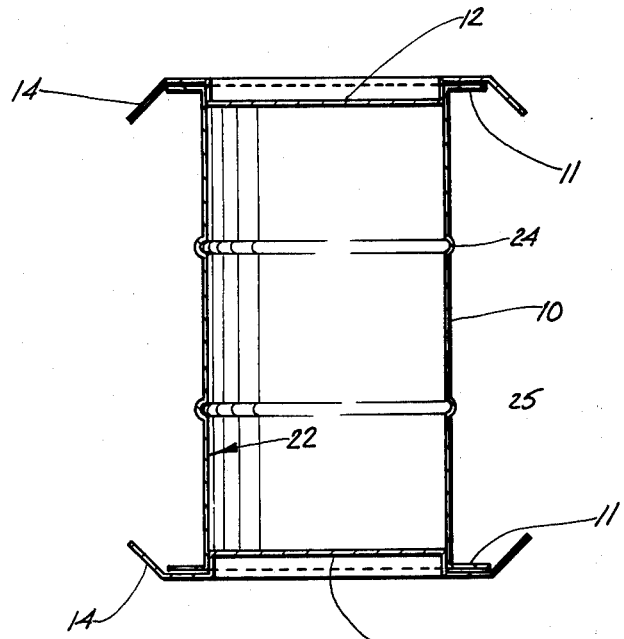
FIGS. 1–4 are schematic illustrations sequentially showing the steps for manufacturing a metal drum in accordance with the method of the present invention.

Conventionally, metal drums, and in particular steel drums, are manufactured by initially forming a sheet of steel of desired length, width and thickness into a cylindrical shape, generally including a pair of rolling hoops 24 and 25, and welding the joint to form a cylindrical shell 10 (see FIG. 1). In the case of tight-head drums, a flange or bead 11 is then formed at each end of cylindrical shell 10. To provide means for sealing the drum, a circular top head 12 and bottom head 13 are cut from another sheet of steel and formed as shown in FIG. 1. The foregoing operations are well known in the art and will therefore be described in no further detail herein.

Figure 2:
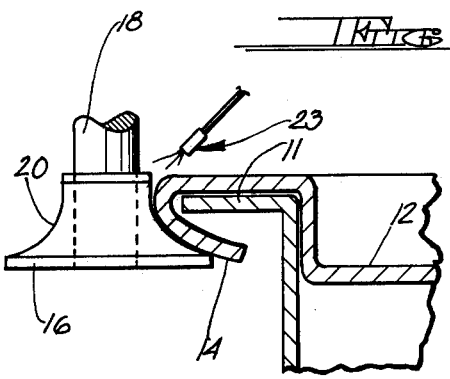
Figure 3:
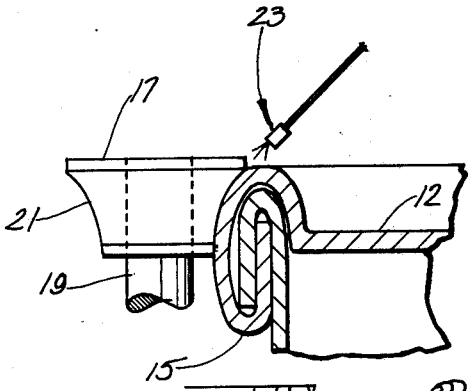

It is also known in the prior art to affix the top head 12 and the bottom head 13 to the cylindrical shell 10 by an operation commonly referred to as "seaming". The "seaming" operation, as illustrated in FIGS. 2 and 3, is performed by a special purpose forming machine known as a "seamer". Since the operation of the "seamer" is identical with regard to both the top head 12 and the bottom head 13, the following discussion will be limited to describing the manner in which the top head 12 is affixed to the cylindrical shell 10, it being understood that the same considerations apply equally to the bottom head 13.

Accordingly, the typical "seamer" initially clamps the top head 12 firmly against the shell 10 and then forms a seam therebetween in a two-step process. First, as seen in FIG. 2, the edge 14 of the top head 12 is folded over flange 11 of shell 10 whereafter a second folding operation is performed, see FIG. 3, to form a tight double-seam 15 which is commonly referred to as the chime. The folding operations are implemented by means of a pair of appropriately configured forming rolls 16 and 17 which are operatively carried by shafts 18 and 19, respectively, for rotation with respect to the drum. In operation, each fold is made by bringing one of the forming rolls 16, 17 into rotational contact with top head 12 for a preset length of time. It will be appreciated that the forming rolls 16, 17, which are typically fabricated from specifically hardened steel or the like, will require, due to their frictional engagement with top head 12 during the previously described folding operations, the application of a lubricant to forming surfaces 20 and 21. Lubricants of the type generally used for this purpose are petroleum based products, an amount of which in the form of a residue remains on the top 12 in the general vicinity of the double-seam or chime 15 after the folding operations have been completed. Although the lubricant residue may be washed away, this is ordinarily not done due primarily to cost considerations.

Figure 4:
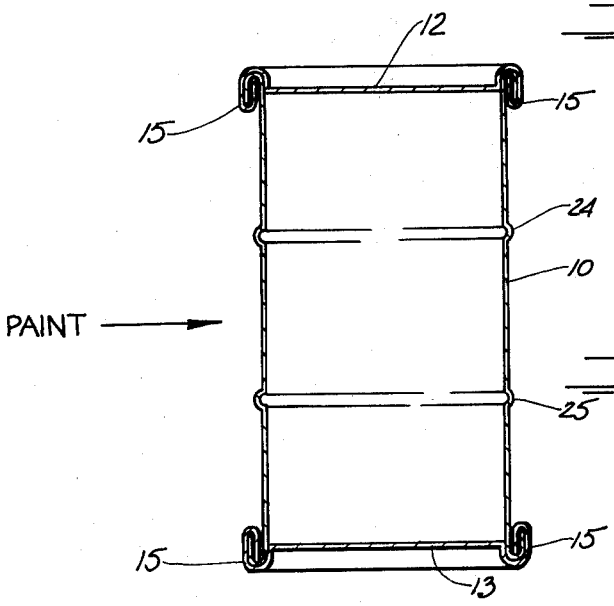

Following the application of top head 12 and bottom head 13 to the shell 10 the drum is normally painted, as schematically illustrated in FIG. 4, whereupon it is ready for shipment to the user. Typically, the painting operation is performed in special purpose automatic high speed spray booths where the drum is rotated while the paint is being applied. The paints typically used during the painting operation are special purpose drum enamels, a variety of which are commercially available, which provide the desired properties of high gloss, good abrasion and mar resistance, good weathering properties such as fade resistance and gloss retention and good corrosion resistance. It has been found that outstanding film properties are obtained by the use of "baking enamels" wherein the applied film is heat-cured in an oven. Also, for certain drum uses, it may be necessary to coat the interior surface 22 of the drum, typically with an epoxy or phenolic coating. In this event, the drums are generally first washed prior to "seaming" and then treated, such as by phosphatizing, to insure a reliable bonding of the coating to the steel surfaces.

Regardless, however, of the precise nature of the painting operation, it will be appreciated that the paint will necessarily be applied over the surface contamination resulting from the lubricant residue in the vicinity of chime 15. This has produced no serious problem in the past since the most frequently used drum coatings have comprised solvent-based formulations which are generally completely compatible with the prior art forming roll lubricants. In other words, where a solvent-based type coating is used to paint the drum, it has been found that the lubricant contamination in the vicinity of the chime 15 does not interfere with or significantly degrade the resulting paint finish.

As mentioned above, most drum coatings now in use comprise solvent-based formulations. Although these solvent-based coatings have been found to be generally satisfactory, in view of the recently increased emphasis on air pollution control and energy conservation, it would be highly desirable to utilize a water-borne formulation in lieu thereof. Exemplary of such water-borne formulations is a coating manufactured by the Inmont Corp. and identified as T146-11 Aqueous White Coating. Unfortunately, the substitution of water-borne drum finishes for solvent-based types has heretofore been unsatisfactory due primarily to the incompatibility between the prior art metal forming lubricants and the water-borne finishes. That is, the surface contamination introduced by the forming roll lubricants so seriously interferes with water-borne coatings that a suitable finish simply cannot be obtained.

After numerous attempts to find a solution to the foregoing problem, namely — the incompatibility between water-borne paint formulations and conventional metal forming lubricants — it has been discovered that the use of butyl lactate in place of conventional metal forming lubricants completely eliminates the aforementioned incompatibility thereby permitting the desirable use of water-borne coatings. It has been observed that when using butyl lactate in place of conventional metal forming lubricants the applied water-borne coating is extremely uniform, exhibits good appearance and good dry film properties and, furthermore, shows no evidence of the presence of lubricant. This is to be contrasted with the rather poor finish that results when conventional metal forming lubricants are used in association with water-borne paint coatings. In addition to these advantages, it has also been observed that the use of butyl lactate to lubricate the forming rolls results in a finished product characterized by improved chimes freer of burrs and sharp edges, exhibiting more uniform dimensions and having fewer leakers. And, not insignificantly, it has been found that the forming rolls themselves do not wear out as rapidly as in the case where conventional lubricants are used.

While the present discussion refers primarily to the use of butyl lactate as a forming roll lubricant, other homologs of lactic acid of the $C_N H_{2N+1}$ series may be used for this purpose including methyl lactate, ethyl lactate, propyl lactate and amyl lactate as well as mixtures thereof.

Although the lubricant, e.g. butyl lactate, may be applied to the forming rolls 16 and 17 by means of various conventional techniques, it is preferred to use a mist spray gun such as schematically shown at 23 in FIGS. 2 and 3. For example, Binks Model 460 Automatic Spray Gun manufactured by the Binks Manufacturing Co. is a commercially available unit which may be used for this purpose. By conventional means (not shown) spray gun 23 may be automated so as to apply a fine mist by butyl lactate lubricant to forming surfaces 20, 21 of the forming rolls 16, 17, for example, during one of the several revolutions comprising a complete folding step. Alternate means for applying the butyl lactate lubricant include the use of felt rollers and/or conventional brushes.

So far as it has been determined, it has not heretofore been proposed to use butyl lactate or the other homologs of lactic acid of the $C_N H_{2N+1}$ series referred to herein as a lubricant. It is therefore believed that the advantages described above directly attributable to the use of these compositions as forming lubricants provide completely unexpected results.

It is to be realized that only preferred embodiments of the present invention have been described and that various modifications and alterations are possible without departing from the spirit and scope of the invention as defined in the following claims. For example, although the preferred embodiments of the present invention have been described in connection with the manufacture of a tight-head drum, it will be apparent that the methods of the invention are equally applicable to the manufacture of full-removable-head drums as well as to other metal forming operations.

What is claimed is:

1. The improved metal deforming and coating process comprising the steps of:

a. lubricating the forming surface of a forming machine with a composition selected from the group consisting of methyl lactate, ethyl lactate, propyl lactate, butyl lactate, amyl lactate or mixtures thereof;

b. deforming a portion of a metallic surface by operation of said forming machine wherein the lubricated forming surface thereof contacts said portion of said metallic surface; and c. applying a water-borne coating to said metallic surface including said portion thereof.

2. The improved process according to claim 1 wherein said lubricating composition consists essentially of butyl lactate.

3. The improved process according to claim 1 wherein said lubricating and deforming steps are performed at least partially simultaneously.

4. For use with machinery of the type having a surface which frictionally contacts another surface thereby requiring the use of a lubricant in association with one of said surfaces, the improved process comprising the step of applying as said lubricant a composition selected from the group consisting of methyl lactate, ethyl lactate, proply lactate, butyl lactate, amyl lactate or mixtures thereof.

5. The improved process according to claim 4 wherein said lubricating composition consists essentially of butyl lactate.

6. In a process of the type utilizing lubricated forming rolls to deform a metallic surface, the improved process comprising the step of lubricating said forming rolls with a composition selected from the group consisting of methyl lactate, ethyl lactate, propyl lactate, amyl lactate or mixtures thereof.

7. The improved process according to claim 6 including the step of applying a water-borne coating to said metallic surface after it has been deformed by said lubricated forming rolls.

8. The improved process according to claim 7 wherein said lubricating composition consists essentially of butyl lactate.

9. In a process for manufacturing metal drums, pails and the like, said process being of the type wherein portions of metallic surfaces are deformed by the forming surfaces of forming machines and subsequently coated, the improvement comprising the steps of:

a. lubricating said forming surfaces with a composition selected from the group consisting of methyl lactate, ethyl lactate, propyl lactate, butyl lactate, amyl lactate or mixtures thereof; and b. coating said metallic surfaces including said deformed portions thereof with a water-borne coating.

10. The improved process according to claim 9 wherein said composition consists essentially of butyl lactate.

* * * * *